US005791561A

United States Patent [19]

Beckmann et al.

[11] Patent Number: 5,791,561

[45] Date of Patent: Aug. 11, 1998

[54] SPRAY GUN ASSEMBLY WITH AN AIR-OPERATED PAINT AGITATION INCLUDING A METAL BELLOWS

[75] Inventors: Jon Dean Beckmann, St. Charles; Gary Norman Karsten, St. Louis, both of Mo.

[73] Assignee: McDonnell Douglas, St. Louis, Mo.

[21] Appl. No.: 720,242

[22] Filed: Sep. 26, 1996

[51] Int. Cl.[6] ..... B01F 13/10; B05B 9/00

[52] U.S. Cl. ..... 239/144; 239/332; 366/605

[58] Field of Search ..... 239/142, 144, 239/332, 318; 366/250, 260, 332, 605

[56] References Cited

U.S. PATENT DOCUMENTS

| | | | |
|---|---|---|---|
| 2,780,444 | 2/1957 | Hickey | 366/332 |
| 3,412,937 | 11/1968 | Chamberlain | 239/142 |
| 4,380,399 | 4/1983 | Godat et al. | 366/605 X |
| 4,401,268 | 8/1983 | Pomponi, Jr. | 239/142 |
| 4,501,500 | 2/1985 | Terrels | 366/250 |
| 4,648,605 | 3/1987 | Marsi | 277/89 |
| 5,454,639 | 10/1995 | Krzywdziak | 366/605 X |
| 5,498,076 | 3/1996 | Krzywdziak | 366/605 X |

*Primary Examiner*—Lesley D. Morris
*Attorney, Agent, or Firm*—Dale B. Halling

[57] ABSTRACT

A hand-held spray gun assembly (10) for spraying paints and other suspensions has a container (12) with a cover (14) sealingly covering the container (12). A motor (70) is attached to the cover (14) and has a piston rod (48) that reciprocates inside a piston assembly (68). A metal bellows (56) has a first end (62) coupled to the piston assembly (68) to form a seal. A shaft assembly (40) has a first end (46) extending through the metal bellows (56) and attached to the piston rod (68). The shaft assembly (40) has a circular flange (52) coupled to a second end (58) of the metal bellows (56) to form a second seal. A second end (39) of the shaft assembly (40) is attached to the paddle (38).

18 Claims, 2 Drawing Sheets

SPRAY GUN ASSEMBLY WITH AN AIR-OPERATED PAINT AGITATION INCLUDING A METAL BELLOWS

FIELD OF THE INVENTION

The present invention relates generally to the field of spray guns and more particularly to a spray gun for spraying paints and other suspensions.

BACKGROUND OF THE INVENTION

Spray guns for applying paint or other suspensions use a pressurized air source to draw the paint out of the container and into a nozzle. When the paint or suspension is not very dense the pressurized air source is used to create a siphon at the nozzle. The siphon creates a pressure difference that pulls the paint through a siphon tube to the air nozzle. At the air nozzle the paint is atomized by the high speed air flowing through the nozzle. When the paint or suspension is dense the siphon method of extracting the paint from the container does not work. For dense paints or suspensions the container must be pressurized to force the paint up through a flow tube to the air nozzle. At the nozzle the paint is mixed with high speed air to atomize the paint.

Paints and other suspensions have to be periodically agitated to keep the paint from separating. Spray guns have been developed that use the pressurized air source to drive an air motor that moves an agitator up and down. The agitator insures that the paint does not separate. One problem that arises with the air motors is that the paint can enter the motor where the shaft connects to the motor. When paint gets into the motor, it ruins the motor. Prior art spray guns use a rubber boot that covers the orifice where a shaft enters the motor. Unfortunately, the rubber boot do not work with the pressurized spray guns because the boot gets pushed against the shaft and rubs against the orifice. This causes the rubber to break down and can jam the motor. Rubber boots have also been found unreliable for siphon spray guns also. The rubber cannot withstand the constant motion and breaks down. Other prior art spray guns have used a magnet sliding inside a fixed, totally enclosed cylinder. The magnet is connected to the motor and on the outside of the cylinder is a metallic annular ring connected to a shaft attached to the paddle. The annular ring, being attracted to the magnet, moves up and down as the magnet moves up and down. The magnetic shaft assembly overcomes the material limitation of the rubber boot. However, the magnetic shaft cannot be used with suspensions having metallic shavings. Another problem is that the paint or suspension must be thoroughly cleaned out of the annular ring after each job. This can be difficult due to the tight fit between the cylinder and the annular ring.

Thus there exists a need for a spray gun that can be used with metallic suspensions, is easy to clean and does not allow paint to enter the motor.

SUMMARY OF THE INVENTION

A hand-held spray gun assembly for spraying paints and other suspension that overcomes these and other problems has a container with a cover sealingly covering the container. A motor is attached to the cover and has a piston rod that reciprocates inside a piston assembly. A metal bellows has a first end coupled to the piston assembly to form a seal. A shaft assembly has a first end extending through the metal bellows and attached to the piston rod. The shaft assembly has a circular flange coupled to a second end of the metal bellows to form a second seal. A second end of the shaft assembly is attached to the paddle.

DETAILED DESCRIPTION OF THE DRAWINGS

Figure 1:
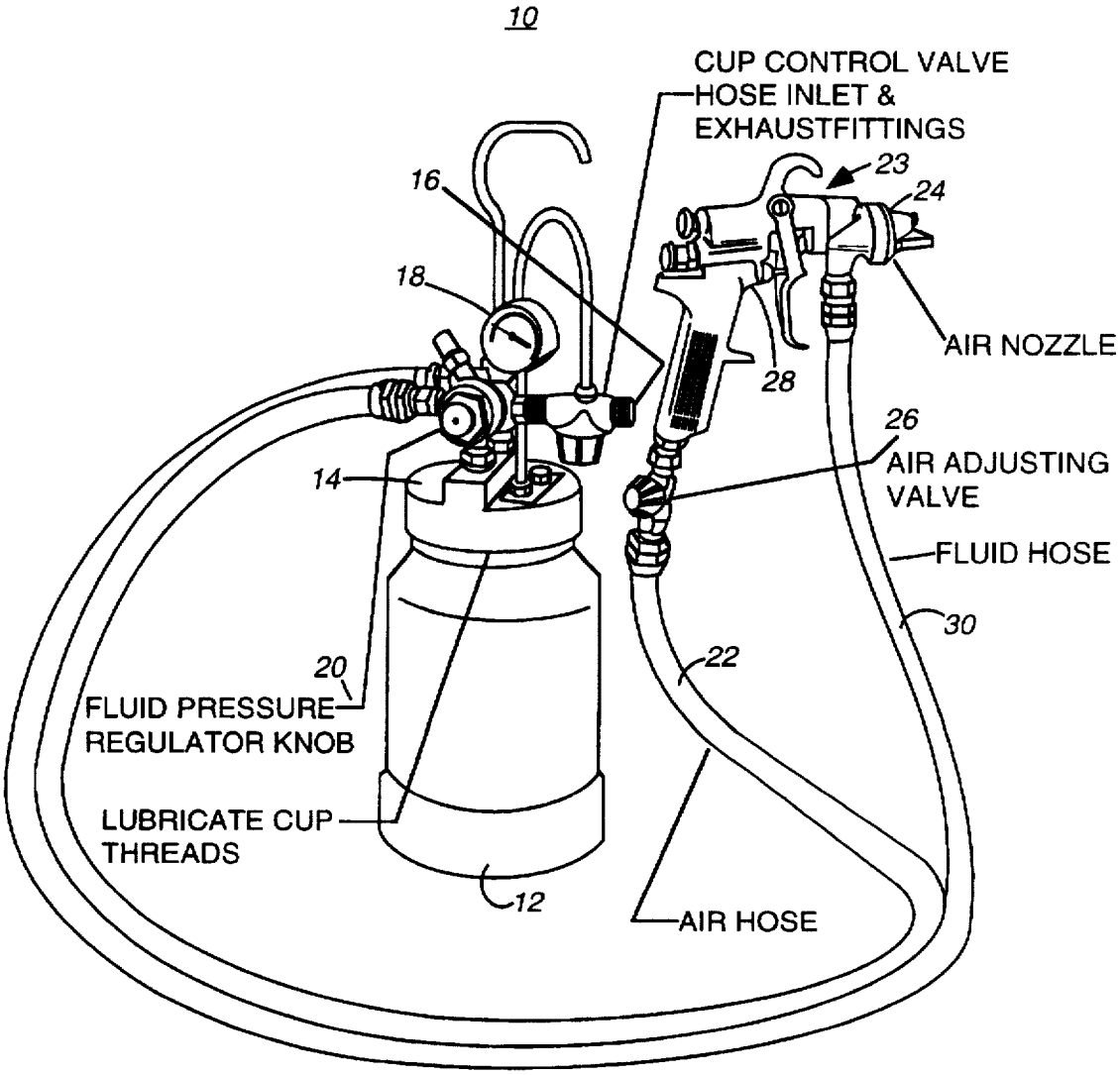
FIG. 1 is a perspective view of a spray gun.

FIG. 1 is a perspective view of a hand-held spray gun assembly 10 for spraying paints and other suspensions. A container (pressurized reservoir) 12 holds the paint or suspension. A cover (cap) 14 seals the container 12. A pressurized air source (not shown) is connected to the spray gun 10 at an air inlet 16. The air pressure inside the container 12 is measured by a pressure valve 18 and can be regulated by a regulator knob 20. Some air from the pressurized air source passes through an air hose 22 and a spray gun 23 to an air nozzle 24. An air adjusting valve 26 controls the amount of air from the air hose 22. The air is used to atomize the paint. A trigger valve 28 connected to the spray gun 23 is actuated by the user to ejected atomized paint from the air nozzle 24. The paint is forced out of the container 12, by the pressure created in the container, and into the fluid hose 30. The fluid hose 30 attaches to the spray gun 23 where the paint in the fluid hose 30 is mixed with the high speed air and atomized.

Figure 2:
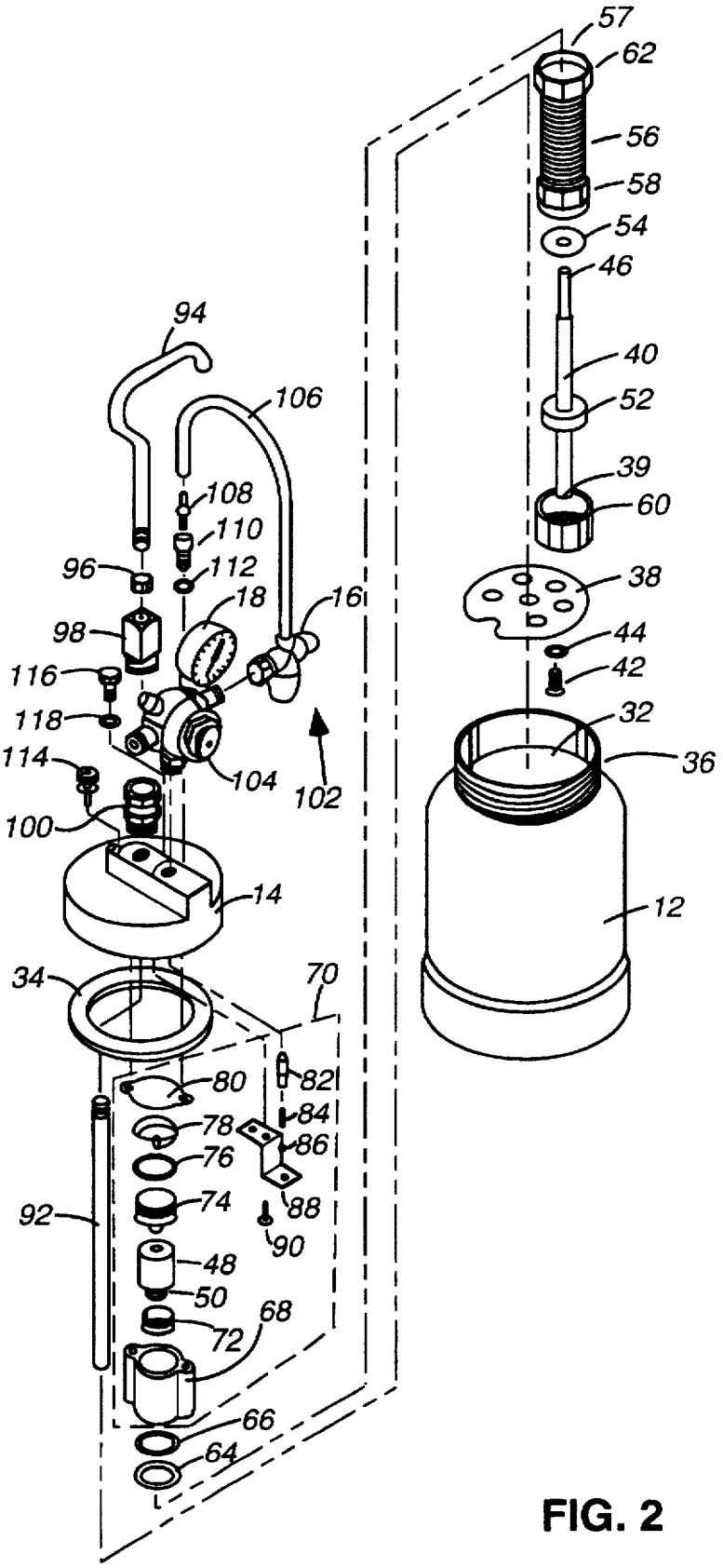
FIG. 2 is a partial exploded view of the spray gun assembly of FIG. 1.

FIG. 2 is a partial exploded view of the spray gun assembly 10 of FIG. 1. The container 12 has an opening 32 that is sealed by a gasket 34 and the cap 14 being screwed onto a threaded lip 36. A paddle 38 residing inside the container 12 is attached to a second end 39 of a shaft assembly 40 by a pan head screw 42 and a star washer 44. A first end 46 of the shaft assembly 40 is connected to a piston rod 48. In one embodiment the first end 46 has a male thread that screws into a female male thread at an end 50 of the piston rod 48. The shaft assembly 40 has a circular flange 52 over which a nylon seal 54 is placed. A metal bellows (bellows, elasticity compressible tube) 56 has a second end 58 that couples to the annular flange 52 by a cover attachment nut 60. The nut 60 screws onto the second end 58 of the metal bellows 56. A first end 62 of the metal bellows 56 has an opening 57 into which fit a can seal 64 and an O-ring 66. The first end 62 screws onto a cylinder assembly 68. An air driven motor (motor) 70 comprises: the cylinder assembly 68, a compression spring 72, the piston rod 48, a piston 74, an O-ring 76, a conical spring 78, a cylinder gasket 80, a valve 82, a spring 84, a washer 86, a bracket 88 and a screw 90. The motor 70 is attached to the cover 14 and is in communication with the high pressure air source. A feed tube 92 is attached to the cover 14.

A handle 94 screws into a nut 96 and into an outlet 98. The outlet 98 screws into a center post assembly 100. An air control valve assembly 102 connects to a regulator assembly 104 that connects to the cover 14. A tube 106 has a connector 108 connected to an inlet fitting 110. Then inlet fitting 110 connects through a gasket 112 to the cover 14. An air release valve 114 connects to the cover 14. An exhaust fitting 116 and gasket 118 connect to the top of the cover.

The shaft assembly 40 and metal bellows 56 provide a sealed fitting between the motor 70 and the paddle 38. The shaft assembly 56 moves up and down as the piston rod 48 moves up and down. The annular flange 52, nylon seal 54 and cap 60 insure a tight seal between the shaft assembly 40 and the second end 58 of the bellows 56. The first end 62 of the bellows 56 is tightly sealed to the motor 70 by the O-ring 64 and the mating threads of the cylinder assembly (piston assembly) 68. As the shaft 40 moves up and down the annular ring 52 moves up and down, compressing the metal bellows 56. Since the bellows 56 is completely sealed, no paint or suspension is allowed up into the motor 70. The spray gun can also be used with suspensions having metallic content because the agitator shaft assembly, comprising the bellows 56, shaft 40 and related parts, has no magnetic parts.

The metal bellows 56 is made from a nickel alloy and can be obtained from Servo-Motion. In one embodiment the bellows 56 is made by welding two compressible sections together and welding a fitting on either ended of the welded compressible sections. The bellows is capable of elastic compression of up to 0.375 inches at 500 cycles per minute with an operating pressure of 15 pounds per square inch. Because the bellows is metal it can be used with a pressurized spray gun without it collapsing and jamming up the shaft at the motor orifice. The bellows is not susceptible to break down due to any solvents used in the suspension or for clean up, including methylene, ethylene ketone (MEK). As a result the metal bellows has an almost infinite life time. In addition the metal bellows 56 is easy to clean up after use, since there are no small crevices or canisters to clean. The bellow's convolutes are just brushed with a solvent to clean the bellows 56.

In one embodiment, the invention is an agitator shaft assembly replacement kit for existing spray guns. For instance, a Binks model 82-790 spray gun can be modified by replacing the magnetic shaft assembly with the metal bellows shaft assembly. The magnetic assembly is removed from the piston rod 48 and the shaft assembly connected to the paddle 38 is also removed. The magnet assembly and shaft assembly are then replaced with the metal bellows 56, nylon seal 54, shaft assembly 40, and cap nut 60.

Thus there has been described a spray gun and agitator assembly that works with metallic suspensions, is easy to clean and does not allow paint to enter the motor. While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A hand-held spray gun assembly for spraying paints and other suspensions, comprising:

a container;

a cover sealingly covering the container;

a motor attached to the cover and having a piston rod that reciprocates inside a piston assembly;

a metal bellows having a first end coupled to the piston assembly to form a seal;

a shaft assembly having a first end extending through the metal bellows and attaching to the piston rod, the shaft assembly having a circular flange coupled to a second end of the metal bellows to form a second seal; and a paddle attached to a second end of the shaft.

2. The hand-held spray gun assembly of claim 1, wherein the container is pressurized.

3. The hand-held spray gun assembly of claim 1, wherein the motor is an air driven motor.

4. The hand-held spray gun assembly of claim 1, wherein the piston assembly has a female threaded portion that mates with a male threaded portion of the first end of the shaft assembly.

5. The hand-held spray gun assembly of claim 3, further including an O-ring between the piston assembly and the first end of the shaft assembly.

6. The hand-held spray gun assembly of claim 1, wherein the metal bellows is made of a nickel alloy.

7. A spray gun assembly for spraying paints and other suspensions, comprising:

a pressurized reservoir having an opening;

a cap sealing the opening of the pressurized reservoir;

an air driven motor having a reciprocating piston rod extending inside the pressurized reservoir;

a bellows having a first end proximate the air driven motor;

a shaft having a first end coupled to the reciprocating piston, the shaft having an annular flange proximate a second end of the bellows; and a paddle coupled to a second end of the shaft.

8. The spray gun of claim 7, wherein the bellows is not soluble in methylene ethylene ketone (MEK).

9. The spray gun of claim 7, wherein the bellows is semirigid.

10. The spray gun of claim 7, wherein the bellows is made from a nickel alloy.

11. The spray gun of claim 7, further including a seal between the air driven motor and the first end of the bellows.

12. The spray gun of claim 7, further including a seal between the second end of the bellows and the annular flange.

13. An agitator shaft assembly for a pressurized spray gun assembly having an agitator motor driving a paddle for stirring a paint or other suspension, comprising:

an elastically compressible tube having a first opening proximate the agitator motor; and a shaft having a first end attached to a piston of the agitator motor and having a flange proximate a second opening of the elastically compressible tube, the shaft having a second end attached to the paddle.

14. The agitator shaft assembly of claim 13, wherein the elastically compressible tube is capable of an elastic compression up to a 0.375 inches.

15. The agitator shaft assembly of claim 14, wherein the elastically compressible tube is only compressible along its length.

16. The agitator shaft assembly of claim 15, wherein the elastically compressible tube requires a pressurized air source with a maximum pressure of fifteen pounds per square inch to compress.

17. The agitator shaft assembly of claim 16, wherein the elastically compressible tube is not soluble in methylene ethylene ketone (MEK).

18. The agitator shaft assembly of claim 17, wherein the elastically compressible tube is made from a nickel alloy.

* * * * *